US010587059B2

(12) United States Patent
Masaki et al.

(10) Patent No.: US 10,587,059 B2
(45) Date of Patent: Mar. 10, 2020

(54) SOCKET WITH ENHANCED INTERNAL INSULATION

(71) Applicant: OMRON Corporation, Kyoto (JP)

(72) Inventors: Kenichiro Masaki, Kyoto (JP); Keisuke Yano, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/276,626

(22) Filed: Feb. 15, 2019

(65) Prior Publication Data

US 2019/0288412 A1 Sep. 19, 2019

(30) Foreign Application Priority Data

Mar. 14, 2018 (JP) ..... 2018-047099

(51) Int. Cl.

| | |
|---|---|
| ***H01R 13/60*** | (2006.01) |
| ***H01R 9/24*** | (2006.01) |
| ***H01R 4/30*** | (2006.01) |
| ***H01R 9/18*** | (2006.01) |
| ***H01R 13/10*** | (2006.01) |
| ***H01R 13/40*** | (2006.01) |

(Continued)

(52) U.S. Cl.

CPC ..... *H01R 9/2416* (2013.01); *H01R 4/30* (2013.01); *H01R 9/18* (2013.01); *H01R 9/26* (2013.01); *H01R 13/10* (2013.01); *H01R 13/40* (2013.01); *H01R 13/506* (2013.01); *H01H 50/02* (2013.01)

(58) Field of Classification Search

CPC . H01H 50/02; H01R 4/30; H01R 9/18; H01R 9/2416; H01R 13/10; H01R 13/40

USPC ..... 439/439, 540.1

See application file for complete search history.

(56) References Cited

U.S. PATENT DOCUMENTS 3,510,822 A * 5/1970 Patterson ..... H01R 4/36 439/107
4,236,778 A * 12/1980 Hughes ..... H01R 9/24 439/406

(Continued)

FOREIGN PATENT DOCUMENTS

| | | |
|---|---|---|
| EP | 0772256 | 5/1997 |
| JP | 2014150014 | 8/2014 |
| WO | 2012039030 | 3/2012 |

OTHER PUBLICATIONS

"Search Report of Europe Counterpart Application", dated Jul. 18, 2019, pp. 1-7.

*Primary Examiner* — Abdullah A Riyami
*Assistant Examiner* — Vladimir Imas
(74) *Attorney, Agent, or Firm* — JCIPRNET

(57) ABSTRACT

The disclosure provides a socket that can easily secure internal insulation. The socket includes a box-shaped first housing and a second housing attached to the first housing. The first housing includes a first wall and a second wall. The first wall extends in a width direction that intersects an opening surface, and has a first opening for inserting a screw member that fixes a conductor part of a wire. The second wall extends in a direction that intersects the opening surface and the first wall, and has a second opening for inserting and removing the conductor part of the wire. The second housing includes a second housing body and a locking arm. The second housing body covers the opening surface. The locking arm extends from the second housing body in the width direction and is locked to the first housing in the width direction.

1 Claim, 4 Drawing Sheets

(51) Int. Cl.

| | |
|---|---|
| ***H01R 9/26*** | (2006.01) |
| ***H01R 13/506*** | (2006.01) |
| *H01H 50/02* | (2006.01) |

(56) References Cited

U.S. PATENT DOCUMENTS

| | | | | |
|---|---|---|---|---|
| 4,343,529 | A * | 8/1982 | Reavis, Jr. | H01R 4/2441 439/406 |
| 5,795,193 | A * | 8/1998 | Yang | H01R 9/2458 439/620.27 |
| 5,973,262 | A * | 10/1999 | Matubara | H01R 4/30 361/622 |
| 6,039,612 | A * | 3/2000 | Brown | H01R 9/2608 439/540.1 |
| 6,257,937 | B1 * | 7/2001 | Baker | H01R 9/2416 439/491 |
| 6,284,980 | B1 * | 9/2001 | Filus | H01R 9/2416 174/135 |
| 6,655,982 | B2 * | 12/2003 | Bolliger | H01R 4/2433 439/395 |
| 6,806,424 | B2 * | 10/2004 | Gerving | H01R 4/34 174/135 |
| 6,817,907 | B2 * | 11/2004 | Cheng | H01R 25/006 439/620.26 |
| 7,303,432 | B1 * | 12/2007 | Chen | H01R 13/518 439/540.1 |
| 7,473,116 | B2 * | 1/2009 | Dudhwala | H01R 4/10 439/212 |
| 7,597,594 | B2 * | 10/2009 | Stadler | H01R 4/30 439/733.1 |
| 7,699,657 | B2 * | 4/2010 | Hwang | H05K 5/0247 439/505 |
| 8,157,584 | B2 * | 4/2012 | Zhou | H01R 13/518 439/540.1 |
| 8,419,476 | B1 * | 4/2013 | Yu | H01R 25/162 439/540.1 |
| 8,562,375 | B2 * | 10/2013 | Chen | H01R 13/518 439/488 |
| 8,579,657 | B2 * | 11/2013 | Reibke | H01R 4/30 439/533 |
| 9,099,795 | B2 * | 8/2015 | Hanses | H01R 9/26 |
| 9,172,158 | B2 * | 10/2015 | Akuta | H01R 9/18 |
| 9,228,605 | B2 * | 1/2016 | Takemura | H01R 9/18 |
| 9,548,547 | B2 * | 1/2017 | Wu | H01H 71/08 |
| 9,667,005 | B2 * | 5/2017 | Pizzi | H01R 9/2675 |
| 10,103,460 | B2 * | 10/2018 | Ono | H01R 4/4827 |
| 10,148,030 | B2 * | 12/2018 | Krech | H01R 4/489 |
| 10,211,569 | B2 * | 2/2019 | Aoki | H01R 13/62933 |
| 10,297,932 | B2 * | 5/2019 | Maesoba | H01R 13/6477 |
| 10,297,933 | B2 * | 5/2019 | Wu | H01R 4/4827 |
| 10,367,276 | B2 * | 7/2019 | Wu | H01R 4/4836 |
| 2007/0178747 | A1 * | 8/2007 | Schrader | H01R 4/4827 439/441 |
| 2009/0207571 | A1 * | 8/2009 | Heggemann | H05K 7/1469 361/752 |
| 2009/0260964 | A1 * | 10/2009 | Orban | H01H 71/0271 200/304 |
| 2010/0081316 | A1 * | 4/2010 | Eppe | H01H 1/5844 439/441 |

* cited by examiner

SOCKET WITH ENHANCED INTERNAL INSULATION

CROSS-REFERENCE TO RELATED APPLICATION

This application claims priority benefits of Japan Patent Application No. 2018-047099 filed on Mar. 14, 2018. The entirety of each of the above-mentioned patent applications is hereby incorporated by reference herein and made a part of this specification.

BACKGROUND

Technical Field

The disclosure relates to a socket.

Description of Related Art

Patent Document 1 discloses a relay terminal block that can be held on a DIN (Deutsches Institut für Normung) rail. The relay terminal block includes a substantially rectangular parallelepiped block, which has a plurality of terminal parts constituted by terminal plates, washers, and screws. In the relay terminal block, the block is constituted by a substantially rectangular plate-shaped base and a box-shaped casing that covers one of the plate surfaces of the base, and a plurality of terminal parts are provided on the upper surface of the casing, which faces the base.

RELATED ART

Patent Document

[Patent Document 1] Japanese Laid-open No. 2014-150014

However, when the terminal block is made thinner, from the viewpoint of improving productivity, for example, it is conceivable to construct the block with a box-shaped base having an opening surface, and a cover attached to the base to cover the opening surface.

Regarding this terminal block, when the screw of the terminal part is turned with a jig or the like, an unintended force may be applied on the base or the cover in a direction inclined with respect to the rotation axis of the screw. In such a case, a gap is formed between the base and the cover near the terminal part, and the inside and the outside of the block communicate with each other via the gap. Therefore, it may be difficult to secure the insulation inside the block.

The disclosure provides a socket that can secure internal insulation.

SUMMARY

A socket according to an example of the disclosure includes:

a box-shaped first housing having an opening surface; and a second housing attached to the first housing to cover the opening surface, wherein the first housing includes:

a first wall extending in a width direction that intersects the opening surface and having a first opening for inserting a screw member that is fixable to a conductor part of a wire; and a second wall extending in a direction that intersects the opening surface and the first wall and having a second opening for being capable to insert and remove the conductor part of the wire, and the second housing includes:

a second housing body covering the opening surface; and a locking arm extending from the second housing body in the width direction and being locked to the first housing in the width direction.

DESCRIPTION OF THE EMBODIMENTS

Hereinafter, an example of the disclosure will be described with reference to the accompanying drawings. In the following description, terms (for example, terms including "upper", "lower", "right", and "left") that indicate specific directions or positions are used as necessary. However, these terms are used to facilitate understanding of the disclosure with reference to the drawings, and the technical scope of the disclosure is not limited by the meanings of these terms. In addition, the following description is merely exemplary and is not intended to limit the disclosure, its application, or its usage. Furthermore, the drawings are schematic, and the ratio of the dimensions does not necessarily agree with the actual one.

Figure 1:
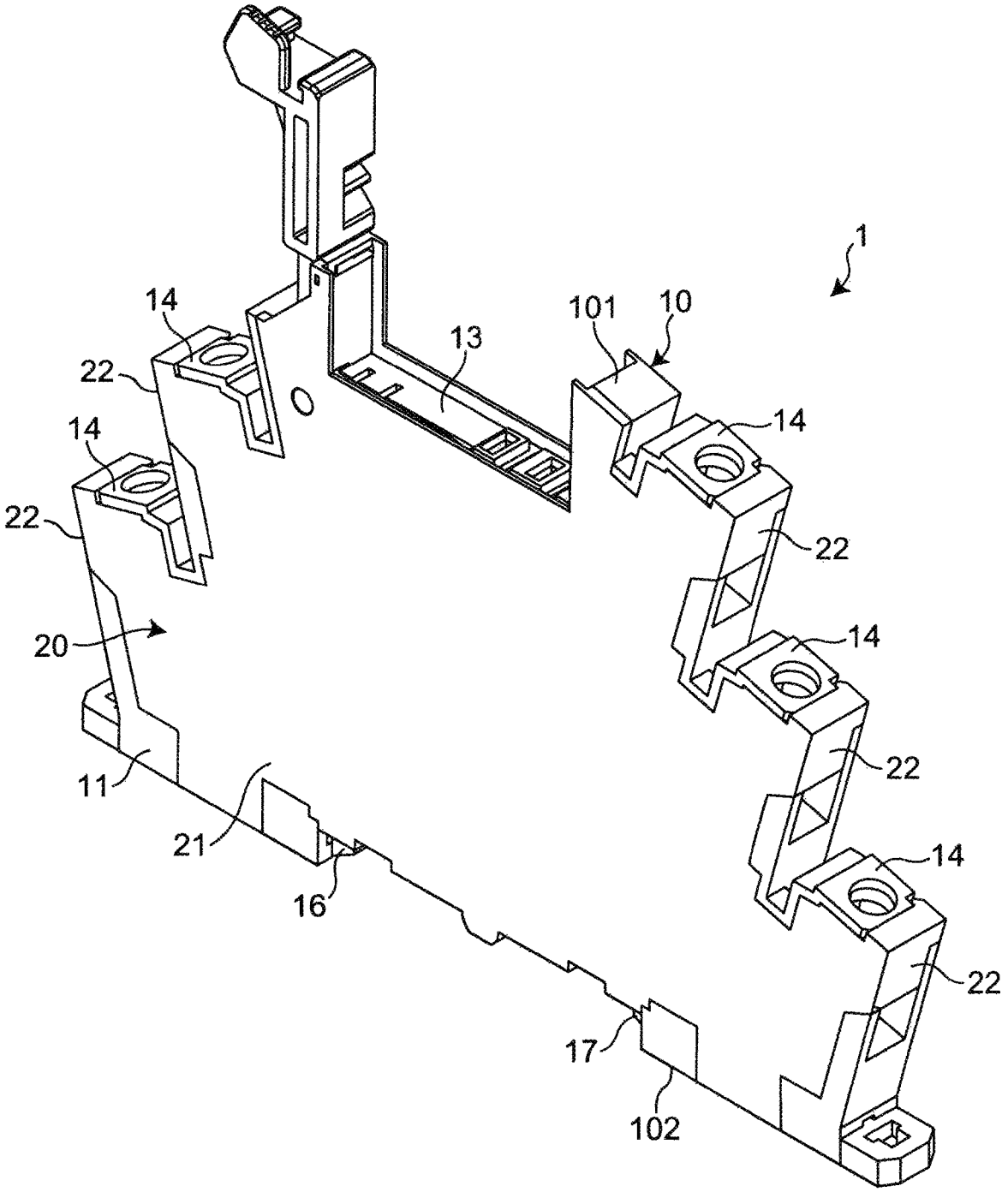
FIG. 1 is a perspective view showing a socket according to an embodiment of the disclosure.
Figure 2:
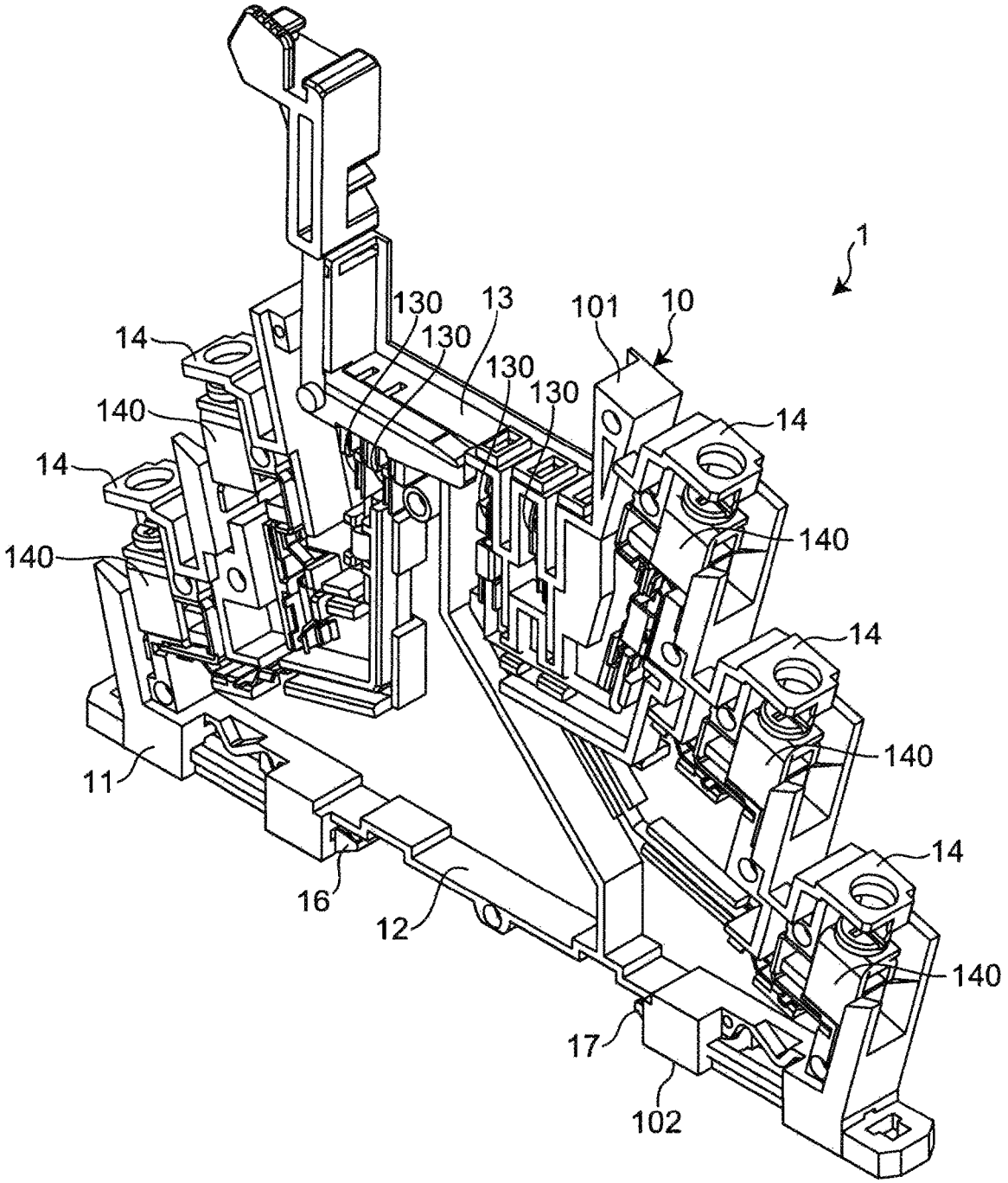
FIG. 2 is a perspective view of the socket of FIG. 1 with a second housing removed.

As shown in FIG. 1, a socket 1 of an embodiment of the disclosure includes a base 10 having an elongated box shape and a casing 20 attached to the base 10. The base 10 is an example of a first housing, and the casing 20 is an example of a second housing. As shown in FIG. 2, the base 10 has an opening surface 11 formed with a base opening 12. The casing 20 is attached to the base 10 to cover the base opening 12 of the opening surface 11.

As shown in FIG. 1, the base 10 has a first side 101 and a second side 102. The first side 101 intersects (for example, is orthogonal to) the opening surface 11, and the second side 102 is opposite to the first side 101. Each of the first side 101 and the second side 102 has a substantially rectangular shape as viewed in a direction that intersects (for example, is orthogonal to) the first side 101 and the second side 102.

Figure 3:
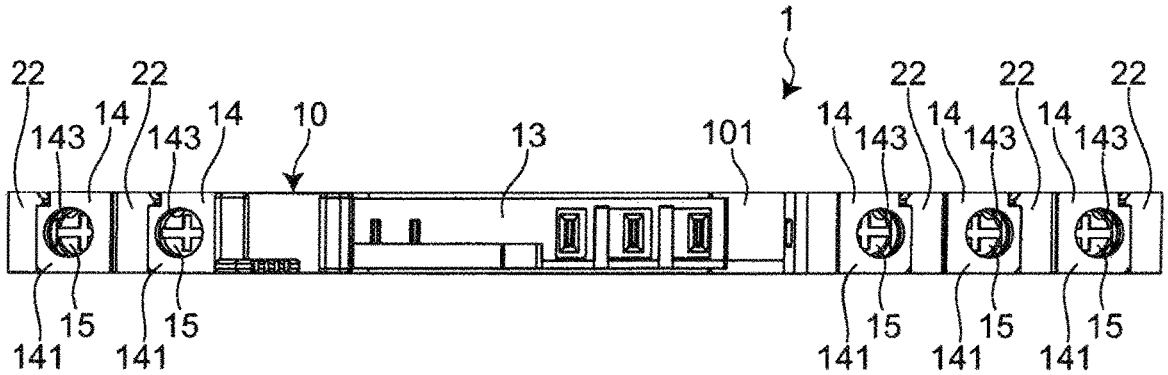
FIG. 3 is a top view of the socket of FIG. 1.

As shown in FIG. 3, a device connection part 13, which can connect an electronic device such as an electromagnetic relay, is disposed at substantially the center of the first side 101 of the base 10 in the longitudinal direction thereof. Wire connection parts 14, which can connect wires respectively, are disposed on two sides of the device connection part 13 in the longitudinal direction of the first side 101. As an example, a plurality of wire connection parts 14 are disposed and arranged side by side in a line at equal intervals along the longitudinal direction of the first side 101.

Two wire connection parts 14 are disposed on one side of the first side 101 in the longitudinal direction with respect to the device connection part 13 (that is, the left side in FIG. 3) and three wire connection parts 14 are disposed on the other side of the first side 101 in the longitudinal direction with respect to the device connection part 13 (that is, the right side in FIG. 3).

As shown in FIG. 2, the device connection part 13 is provided with first terminal connection parts 130, which can connect a terminal of the electromagnetic relay, for example. In addition, each wire connection part 14 is provided with a second terminal connection part 140, which can connect a conductor part of a wire. The first terminal connection parts 130 and the second terminal connection parts 140 are electrically connected inside the base 10 and the casing 20.

Figure 4:
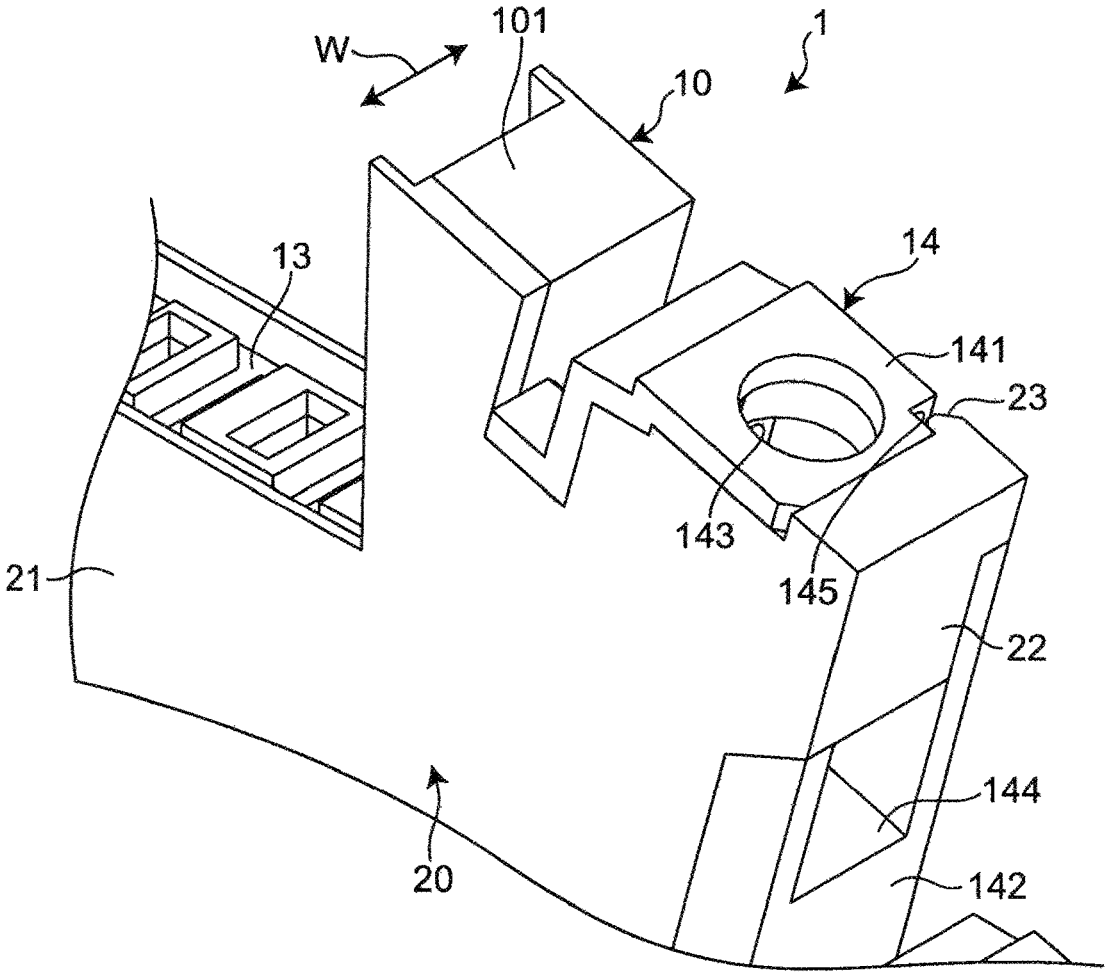
FIG. 4 is a partially enlarged perspective view of a wire connection part of the socket of FIG. 1.

As shown in FIG. 4, each wire connection part 14 has a first wall 141 and a second wall 142. The first wall 141 extends in a width direction W that intersects the opening surface 11, and the second wall 142 extends in a direction that intersects the opening surface 11 and the first wall 141. That is, the base 10 has the first wall 141 and the second wall 142.

The first wall 141 has a substantially circular first opening 143 and a locking recess 145. A screw member 15 (shown in FIG. 3), which fixes the conductor part of the wire, can be inserted into the first opening 13, and a locking claw 23 (which will be described later) of the casing 20 is locked to the locking recess 145. In addition, the second wall 142 has a substantially rectangular second opening 144. The conductor part of the wire can be inserted into or removed from the second opening 144. Nevertheless, the first opening 143 and the second opening 144 can have any shapes according to the design of the socket 1 or the like.

Furthermore, as shown in FIG. 1, a first locking part 16 and a second locking part 17 are respectively provided at two end portions of the second side 102 of the base 10 in the longitudinal direction. The first locking part 16 and the second locking part 17 are configured to lock to the base 10 to a rail (for example, a DIN rail).

As shown in FIG. 1, the casing 20 has a casing body 21 (an example of a second housing body) and a locking arm 22 disposed on the casing body 21. The casing body 21 covers the base opening 12 of the opening surface 11 of the base 10. As an example, a plurality of locking arms 22 are disposed on an edge of the casing body 21 and are respectively arranged at positions of the casing body 21 corresponding to the wire connection parts 14 of the base 10.

As shown in FIG. 4, each locking arm 22 is disposed near the first opening 143 and between the first wall 141 and the second wall 142 of the wire connection part 14. That is, the first wall 141 and the second wall 142 of each wire connection part 14 are adjacent via the locking arm 22.

Specifically, each locking arm 22 has a substantially rectangular plate shape, and one side extending in the width direction W is disposed substantially flush with the first wall 141 and one plate surface is disposed substantially flush with the second wall 142. Moreover, the other side, which extends in the width direction W, of each locking arm 22 constitutes one side of the second opening 144.

Further, as shown in FIG. 4, each locking arm 22 is configured to extend from the casing body 21 in the width direction W and to be locked to the base 10 in the width direction W. Specifically, the locking claw 23, which is formed to face the casing body 21, is disposed at an end portion of each locking arm 22, wherein the end portion is farther from the casing body 21 in the width direction W. The locking claw 23 is disposed on each wire connection part 14 of the base 10 and is configured to be locked to the locking recess 145.

Figure 5:
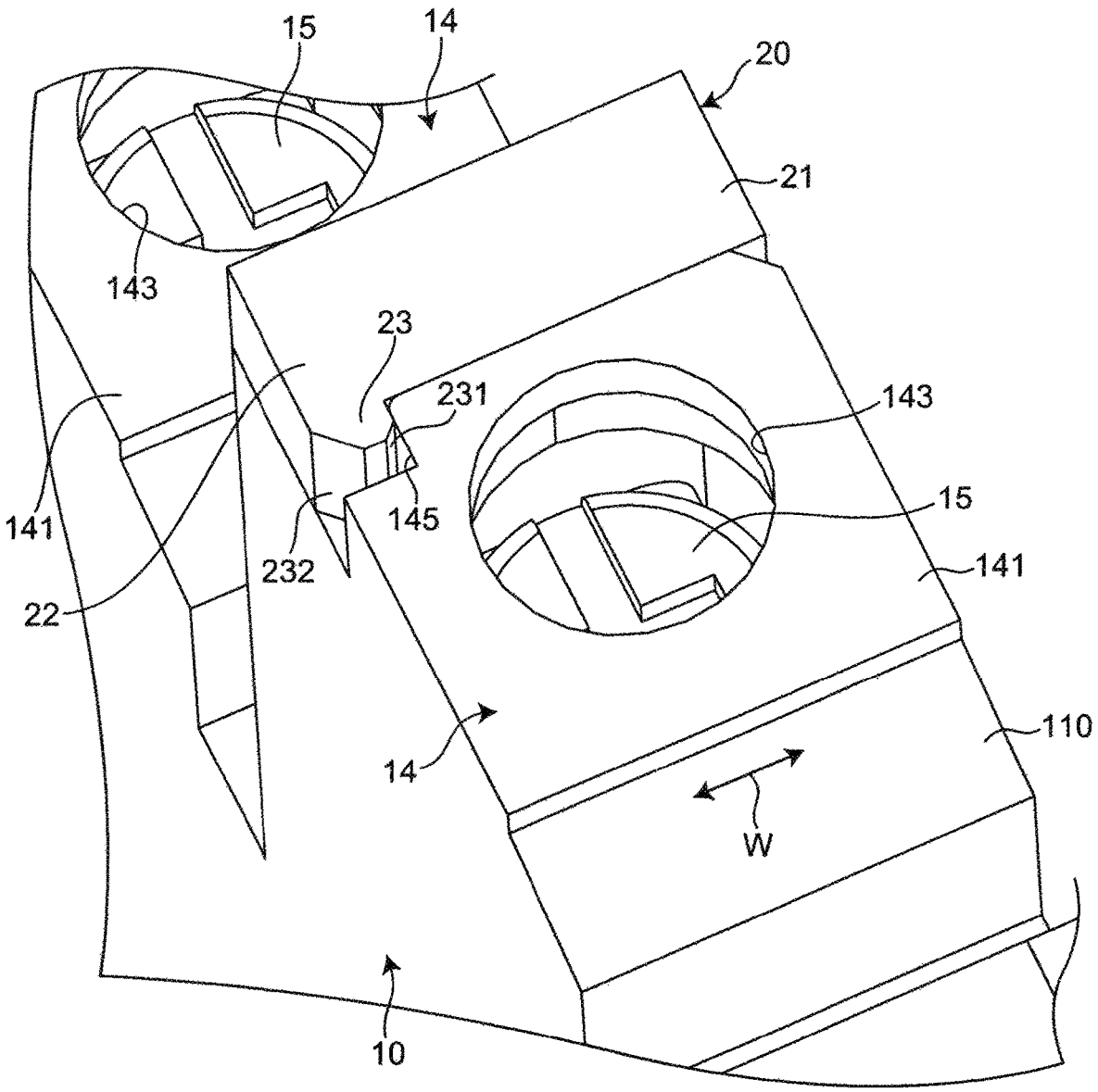
FIG. 5 is a partially enlarged perspective view of the wire connection part of the socket of FIG. 1 as viewed in a direction different from that of FIG. 4.

As shown in FIG. 5, the locking claw 23 has inclined surfaces 231 and 232 at an end portion that is farther from the locking arm 22 in the longitudinal direction of the first side 101. The inclined surface 231 is formed at a portion of the locking claw 23, which faces the casing body 21 (that is, a surface that faces the locking recess 145 in the width direction W), and is inclined in the width direction W and in a direction away from the casing body 21 as it goes away from the locking min 22 in the longitudinal direction of the first side 101. Further, the inclined surface 232 is formed on the locking claw 23 on the side opposite to the inclined surface 231 in the width direction W. The inclined surface 232 is inclined in the width direction W and in a direction toward the casing body 21 as it goes away from the locking arm 22 in the longitudinal direction of the first side 101.

The socket 1 described above includes the box-shaped base 10 and the casing 20 attached to the base 10. The casing 20 has the casing body 21 and the locking arm 22, which extends from the casing body 21 in the width direction W to be locked to the base 10 in the width direction W. Because of the locking of the locking arm 22, even if an external force is applied to the base 10 or the casing 20 to separate the two members from each other, it is possible to prevent an unintended gap from being formed between the base 10 and the casing 20. Therefore, it is possible to realize the socket 1 that can secure internal insulation.

In addition, the locking arm 22 is disposed near the first opening 143 and between the first wall 141 and the second wall 142. As a result, the locking arm 22 can be more reliably locked to the base 10. Therefore, even if an external force that may separate the base 10 and the casing 20 from each other is applied to the base 10 or the casing 20, it is possible to more reliably prevent an unintended gap from being formed between the base 10 and the casing 20.

Moreover, the casing 20 has the locking claw 23 that is formed to face the casing body 21 at the end portion of the locking arm 22, which is farther from the casing body 21 in the width direction W. The first wall 141 of the base 10 has the locking recess 145 that locks the locking claw 23. With the locking claw 23, it is possible to prevent an unintended gap from being formed between the base 10 and the casing 20 with a simple configuration.

Further, the locking claw 23 has the first inclined surface 231 that is formed at the portion facing the casing body 21, and the first inclined surface 231 is inclined in the width direction W and in the direction away from the casing body 21 as it goes away from the locking arm 22. When the locking claw 23 is locked to the base 10, the first inclined surface 231 can slide with respect to the base 10. Therefore, the casing 20 can be easily attached to the base 10, and the productivity of the socket 1 can be increased.

Nevertheless, the locking arm 22 is not necessarily disposed near the first opening 143 and between the first wall 141 and the second wall 142. The locking arm 22 can be disposed at any position to be locked to the base 10 in the width direction W of the casing body 21.

The disclosure is not limited to the case where the base 10 and the casing 20 respectively have the locking claw 23 and the locking recess 145. The disclosure may adopt any configuration for locking the locking arm 22 to the base 10 in the width direction W.

Furthermore, in the socket 1, the base 10 constitutes the first housing and the casing 20 constitutes the second housing. However, the disclosure is not limited thereto. For example, the casing may constitute the first housing and the base may constitute the second housing. That is, the casing may be configured to have the locking arm.

The inclined surfaces 231 and 232 of the locking claw 23 can be omitted.

Although various embodiments of the disclosure have been described in detail above with reference to the drawings, finally various aspects of the disclosure will be described. The following description is provided with reference numerals as an example.

A socket 1 according to the first aspect of the disclosure includes:

a box-shaped first housing 10 having an opening surface 11; and a second housing 20 attached to the first housing 10 to cover the opening surface 11, wherein the first housing 10 includes:

a first wall 141 extending in a width direction W that intersects the opening surface 11 and having a first opening 143 for inserting a screw member 15 that is fixable to a conductor part of a wire; and a second wall 142 extending in a direction that intersects the opening surface 11 and the first wall 141 and having a second opening 144 for being capable to insert and remove the conductor part of the wire, and the second housing 20 includes:

a second housing body 21 covering the opening surface 11; and a locking arm 22 extending from the second housing body 21 in the width direction W and being locked to the first housing 10 in the width direction W.

According to the socket 1 of the first aspect, even if an external force that may separate the first housing 10 and the second housing 20 from each other is applied to the first housing 10 or the second housing, with the locking arm 22, it is possible to prevent an unintended gap from being formed between the first housing 10 and the second housing 20, so it is possible to realize the socket 1 that can secure internal insulation.

In the socket 1 according to the second aspect of the disclosure, the locking arm 22 is disposed near the first opening 143 and between the first wall 141 and the second wall 142.

According to the socket 1 of the second aspect, the locking arm 22 can be more reliably locked to the first housing 10. Therefore, even if an external force that may separate the first housing 10 and the second housing 20 from each other is applied to the first housing 10 or the second housing 20, it is possible to more reliably prevent an unintended gap from being formed between the first housing 10 and the second housing 20.

In the socket 1 according to the third aspect of the disclosure, the second housing 20 includes a locking claw 23, which is disposed to face the second housing body 21, at an end portion of the locking arm 22, wherein the end portion is farther from the second housing body 21 in the width direction W. The first wall 141 of the first housing 10 includes a locking recess 145 that locks the locking claw 23.

According to the socket of the third aspect, with the locking claw 23, it is possible to prevent an unintended gap from being formed between the first housing 10 and the second housing 20 with a simple configuration.

In the socket 1 according to the fourth aspect of the disclosure, the locking claw 23 has an inclined surface 231 formed at a portion that faces the second housing body 21, and the inclined surface 231 is inclined in the width direction W and in a direction away from the second housing body 21 as the inclined surface 231 goes away from the locking arm 22.

According to the socket 1 of the fourth aspect, when the locking claw 23 is locked to the base 10, the first inclined surface 231 can slide with respect to the base 10. Therefore, the second housing 20 can be easily attached to the first housing 10, and the productivity of the socket 1 can be increased.

The socket includes the box-shaped first housing and the second housing attached to the first housing. The second housing includes the second housing body and the locking arm, which extends from the second housing body in the width direction to be locked to the first housing in the width direction. Even if an external force is applied to the first housing or the second housing to separate the two members from each other, with the locking arm, it is possible to prevent an unintended gap from being formed between the first housing and the second housing. Therefore, it is possible to realize a socket that can secure internal insulation.

Any of the various embodiments or modified examples may be combined as appropriate to achieve the respective effects. It is also possible to combine the embodiments, to combine the examples, or to combine the embodiments with the examples, and to combine features in different embodiments or examples.

INDUSTRIAL APPLICABILITY

The socket of the disclosure can be used in a control panel, for example.

What is claimed is:

1. A socket, comprising:

a first housing being box-shaped and having an opening surface; and a second housing attached to the first housing to cover the opening surface, wherein the first housing comprises:

a first wall extending in a width direction that intersects the opening surface and having a first opening for inserting a screw member that is fixable to a conductor part of a wire; and a second wall extending in a direction that intersects the opening surface and the first wall and having a second opening for being capable to insert and remove the conductor part of the wire, and the second housing comprises:

a second housing body covering the opening surface; and a locking arm extending from the second housing body in the width direction and being locked to the first housing in the width direction, wherein the locking arm is disposed near the first opening and between the first wall and the second wall, wherein the second housing comprises a locking claw, which is disposed to face the second housing body, at an end portion of the locking arm, wherein the end portion is farther from the second housing body in the width direction, and the first wall of the first housing comprises a locking recess that locks the locking claw, wherein the locking claw has an inclined surface formed at a portion that faces the second housing body, and the inclined surface is inclined in the width direction and in a direction away from the second housing body as the inclined surface is being away from the locking arm.

* * * * *